United States Patent [19]

Mirkovich et al.

[11] 4,331,329

[45] May 25, 1982

[54] REBOUND EXERCISER

[76] Inventors: Konstantin Mirkovich; Joyce M. Mirkovich, both of 3909 Via Manzana, San Clemente, Calif. 92672

[21] Appl. No.: 251,304

[22] Filed: Apr. 6, 1981

[51] Int. Cl.[3] ..... A63B 5/08

[52] U.S. Cl. ..... 272/65

[58] Field of Search ..... 272/65, 70, 144; 182/138, 139, 140; 5/110, 111, 114

[56] References Cited

U.S. PATENT DOCUMENTS

| | | | |
|---|---|---|---|
| 1,456,168 | 5/1923 | Witmer et al. | 182/139 X |
| 2,112,454 | 3/1938 | Davis | 5/114 |
| 2,252,310 | 8/1941 | Waldman | 5/111 X |
| 3,031,688 | 5/1962 | Southwood | 182/139 X |
| 3,233,895 | 2/1966 | Grelle et al. | 182/139 X |
| 3,983,585 | 10/1976 | Sidlinger | 182/139 X |
| 4,139,192 | 2/1979 | McNeil | 272/65 |
| 4,284,271 | 8/1981 | Pettit et al. | 182/139 X |

FOREIGN PATENT DOCUMENTS

| | | | |
|---|---|---|---|
| 960130 | 12/1974 | Canada | 5/110 |
| 494649 | 5/1954 | Italy | 5/110 |
| 542335 | 1/1942 | United Kingdom | 272/65 |

*Primary Examiner*—Richard J. Apley
*Attorney, Agent, or Firm*—Fred N. Schwend

[57] ABSTRACT

The diaphragm of a rebound exerciser is supported within a rigid frame by a resilient lacing which is threaded spirally through holes in the diaphragm and around the frame. Padding members of resilient material are mounted over the frame and extend over the peripheral edge of the diaphragm. Slots in the padding members embrace the lacing permitting the padding members to be of low profile and preventing shifting of such members as a result of violetn action imparted to the diaphragm.

8 Claims, 6 Drawing Figures

REBOUND EXERCISER

BACKGROUND OF THE INVENTION

1. Field of the Invention

This invention relates to rebound exercisers, trampolines and the like.

2. Description of the Prior Art

Rebound exercisers have become increasingly popular, largely due to their therapeutic value in promoting better health, and as an aid to strengthening heart and other body muscles, in addition to the exhilerating experience derived from bouncing on a thin diaphragm which is stretched taut within a supporting frame.

Modern rebound exercisers are generally made in circular form with a relatively small overall diameter of from three to four feet, permitting the exerciser to be used within a small space and to enable the exerciser to be easily carried about and stored in one's home. Therefore, it is highly desirable that as much as possible of the surface of the diaphragm be usable for bouncing.

Heretofore, radially extending springs have generally been mounted between the diaphragm and the supporting frame to impart a desired resiliency or bounce to the diaphragm. Although such springs are generally satisfactory, they require considerable space between the peripheral edge of the diaphragm and the frame in order to be effective and thus reduce the usable bouncing area. This construction also leaves spaces between the peripheral edge of the diaphragm and the frame through which the jumper could possibly step, resulting in possible injury. Further, if any of the springs should break while under the relatively high stresses incurred during bouncing, the broken parts tend to be impelled into the air at high velocities with possible injurious results. Obviously, injury could also occur if the jumper, while bouncing on the exerciser, should strike or fall against the rigid frame. Further, certain exercises call for the jumper to bounce while in a sitting position on the edge of the frame or while lying across the same, resulting in discomfort if not injury.

Attempts have been made heretofore to overcome the above problems by wrapping padding material around the frame, but in order to be effective, the padding had to be so thick that the jumper tended to stumble or trip over the same when he or she mounted or dismounted from the exerciser or performed certain exercises while bouncing near the edge of the diaphragm. Also, such padding material tended to become dislodged or disarranged due to the violent action often imparted to the diaphragm and its supporting springs during the process of bouncing thereon.

SUMMARY OF THE INVENTION

A principal object of the present invention is to provide a rebound exerciser of the above type in which a maximum area of the diaphragm may be safely utilized for bouncing.

Another object is to provide a rebound exerciser in which the usual radially extending tension springs for resiliently supporting the diaphragm are eliminated.

Another object is to provide a rebound exerciser of the above type having protective padding over the supporting frame which is of a minimum height above the level of the diaphragm and which will not become disloged or disarranged during violent bouncing.

Another object is to prevent the possibility of a jumper stepping between the peripheral edge of the diaphragm and the supporting frame during any bouncing activity.

According to the invention, the diaphragm of a rebound exerciser is supported from a supporting frame by a resilient lacing which is laced in a spiral fashion through spaced holes in the diaphragm and around the frame. Resilient padding material is mounted over the frame and extends inwardly over the peripheral edge of the diaphragm and is provided with slots which embrace the lacing to reduce the height of the padding material and to lock the padding material in place. Overlapping, radially extending fabric retainer strips are stretched taut over the padding material to hold the latter in place and to hold it against the frame and over the outer edge portion of the diaphragm.

BRIEF DESCRIPTION OF THE DRAWING

The manner in which the above and other objects of the invention are accomplished will be readily understood on reference to the following specification when read in conjunction with the accompanying drawings, wherein.

DESCRIPTION OF THE PREFERRED EMBODIMENT

Figure 1:
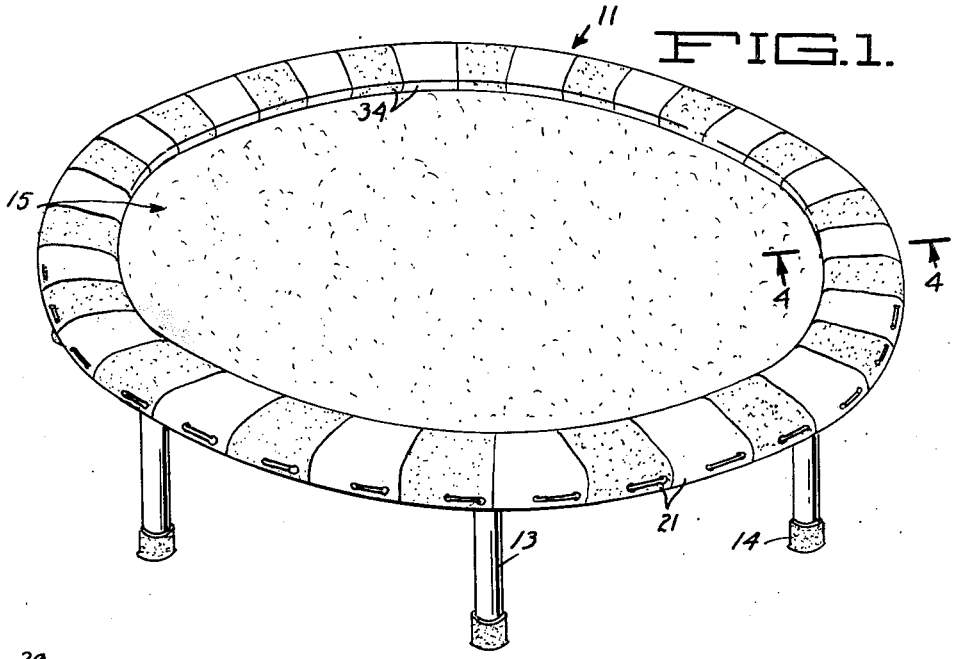
FIG. 1 is a perspective view of a rebound exerciser embodying a preferred form of the present invention.
Figure 2:
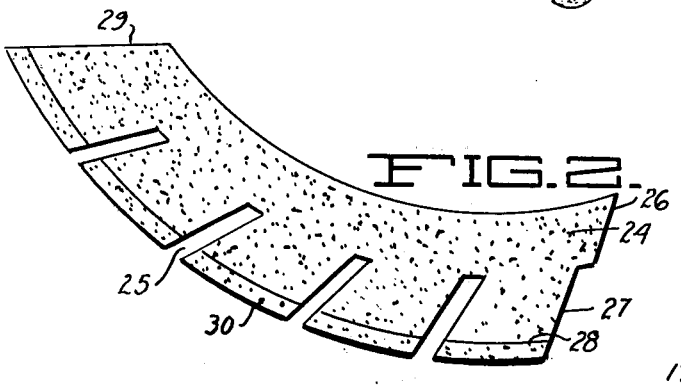
FIG. 2 is a plan view of one of the arcuate lower padding members.

While this invention is susceptible to embodiment in many different forms, there is shown in the drawings and will be described in detail one specific embodiment and one modified embodiment, with the understanding that the present disclosure is to be considered as an exemplification of the principles of the invention and is not intended to limit the invention to the embodiments illustrated. The scope of the invention will be pointed out in the appended claims.

Referring in particular to FIGS. 1 to 4, the rebound exerciser is generally indicated at 11 and comprises a rigid tubular frame 12 which is circular in form and circular in cross section, and is supported by a plurality of spaced vertical legs 13 integrally connected thereto, as by welding. The legs 13 are provided with resilient tips 14 for mounting the exerciser on a floor surface.

Figure 3:
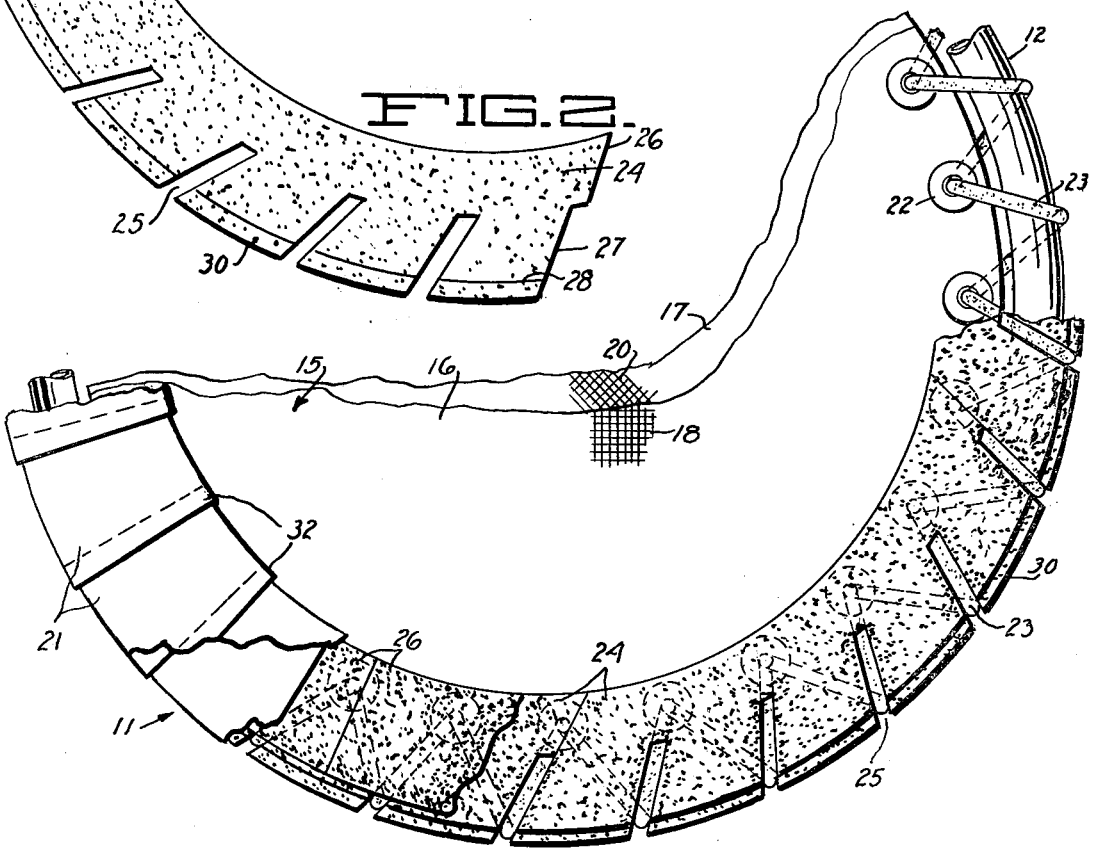
FIG. 3 is a plan view, with parts broken away, of the rebound exerciser.

A circular diaphragm, generally indicated at 15, is provided having a diameter slightly less than the inside diameter of the frame 12. Such diaphragm is formed of two superimposed sheets 16 and 17, each preferably formed of nylon mesh fabric coated on opposite sides with a vinyl plastic. As seen in FIG. 3, the mesh 18 of the upper diaphragm sheet 16 is oriented at an angle of approximately 45° to the mesh 20 of the lower sheet 17 to impart equal strength to the diaphragm in all directions in its plane and to resist stretching. The sheets 16 and 17 are secured together at spaced intervals adjacent their outer edges and to radially extending retainer strips 21 by annular metal grommets 22 and by a suitable adhesive applied intermediate adjacent surfaces of the sheets and the strips 21.

A resilient lacing 23 of elastomeric material, preferably virgin rubber, having a circular cross section, is threaded in a spiral fashion through the grommets 22 and around the frame 12. The lacing is stretched to hold the diaphragm taut within the frame 12 and to enable a certain amount of deflection of the diaphragm when a jumper is bouncing thereon.

In order to adequately protect a jumper from injury in the event he should fall or lay against the edge of the exerciser, as well as to protect the outer periphery of the diaphragm and to present a pleasing and aesthetic appearance, padding is provided to cover the frame and outer periphery of the diaphragm. Such padding comprises a series of six arcuate lower padding members 24, one of which is shown in detail in FIG. 2, of uniform thickness throughout. The members 24 are laid end to end over the frame 12 and over the outer periphery of the diaphragm 15. The members 24 are formed of a multi-cellular, elastomeric plastic material, preferably that known in the trade as Ethafoam which is available from the Wilshire Foam Products, Inc. of Carson, Calif.

Figure 4:
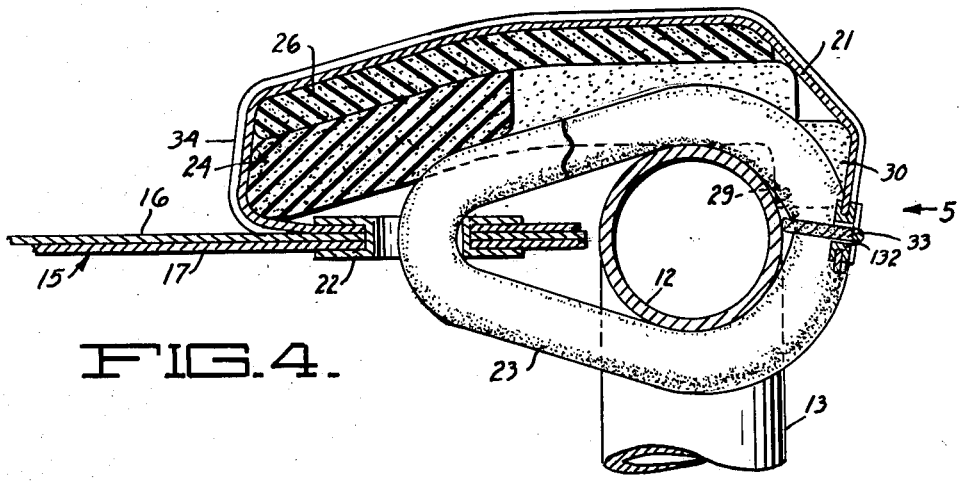
FIG. 4 is an enlarged transverse sectional view taken substantially along the line 4—4 of FIG. 1.

Each padding member 24 is formed with a plurality of spaced slots 25 extending partly thereacross and each arranged at an angle to the center of radius of the member to fit over the upper strands of the lacing 23 as shown in FIGS. 3 and 4. The right hand end 26 of each member 24 is formed at the same angle to the center of radius as are the slots 25 and has a notched portion 27 to fit against the mating strand of the lacing 23. Likewise, the left hand end 29 of the member 26 is formed at the same angle to the center of the radius as is the right hand end to fit against a mating strand of the lacing and also against the right hand end of an adjacent member.

In addition, each member 24 is arcuately slit at 28 to a depth of approximately two-thirds of the thickness of the member, permitting the resulting outer section 30 to be bent downwardly at right angles to the remaining inner section of the member, whereby to abut against the side of the frame 12, as indicated at 29 in FIG. 4.

Three acruate upper pads 26 of uniform thickness throughout are laid end to end over the six padding members 24 and overlap the ends of the padding members to provide additional padding and to cover the slots 25 in such lower padding members. Pads 26 are also preferably formed of Ethafoam.

Figure 5:
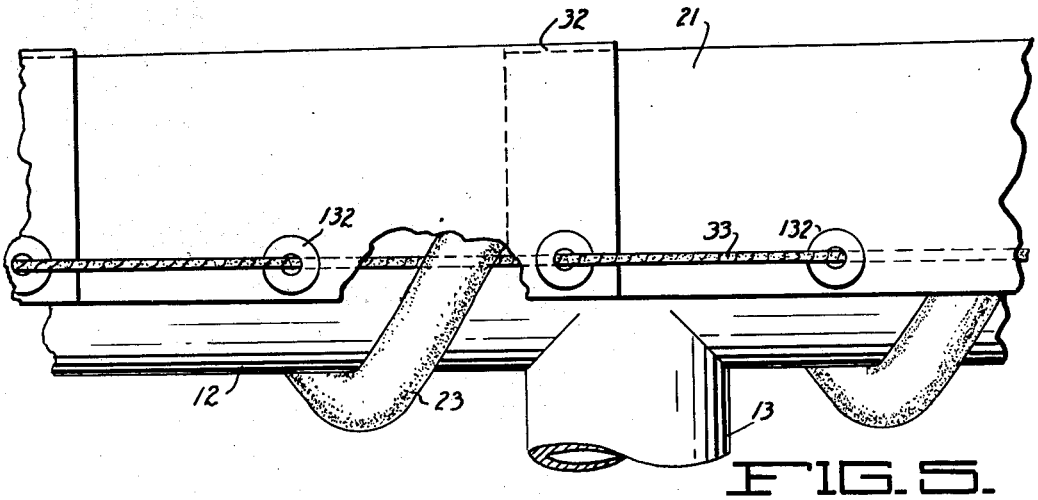
FIG. 5 is a fragmentary side view taken in the direction of the arrow 5 in FIG. 4.

The aforementioned radially extending retainer strips 21 overlap each other laterally, as indicated at 32 in FIGS. 3 and 5. Such strips are preferably formed of nylon mesh fabric coated with vinyl and is suitable adhesive (not shown) is preferably interposed between the overlapped portion 32 to prevent relative laterial shifting of the strips 21.

For the purpose of securing the outer edges of the retainer strips 21 in taut condition, annular metal grommets 132, FIGS. 4 and 5, are secured thereto and a lacing 33 of cord is passed in an undulating manner through the grommets and under the strands of the resilient lacing 23, as seen in FIG. 5. The ends of the lacing 33 are suitably tied together to hold the lacing taut.

Since the slots 25 in the lower padding members 24 embrace the sides of the strands of lacing 23, the overall height of the padding is reduced to a minimum while still providing protection against injury. Also, the various strands of lacing 23 prevent disarrangement or shifting of the padding members 24 which tends to occur due to violent action of the diaphragm. Further, when the retaining strips 21 are held taut against the padding members 24 and 26, they deflect the latter downwardly toward the diaphragm 15 to present a minimum height lip 34 so as to minimize any tendency for the jumper to trip or stumble thereagainst, either when jumping or when dismounting from the exerciser.

It will be noted that the aforementioned construction enables a maximum area of the diaphragm 15 to be used and even permits the jumper to bounce on the portion of the padding extending inwardly over the periphery of the diaphragm. Obviously, also, the construction eliminates any possibility of the jumper stepping between the outer periphery of the diaphragm and the frame 12.

Additionally, since the padding members 24 and 26 extend over the outer periphery of the diaphragm as well as over the side of the frame 12, a relatively large padded area is provided which is effective to cushion any downward fall toward the frame 12.

Figure 6:
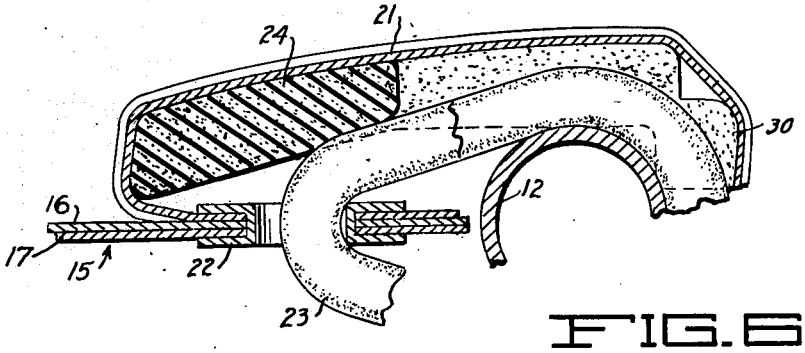
FIG. 6 is a sectional view, with parts broken away, similar to that of FIG. 4, but illustrating a modified form of the invention.

FIG. 6 illustrates a modified form of the invention in which the upper padded members 26 of FIG. 4 are omitted and the retainer strips 21 are stretched taut over the lower padding members 24. Although such construction may not provide the amount of protection against injury provided by that shown in FIG. 4 and may result in portions of the strips 21 indenting somewhat into the slots 25, it may give sufficient protection against injury in most cases.

Although the material of the aforementioned padding members 24 and pads 26 may be of any suitable hardness, it has been found that having a compressive strength of approximately 5 p.s.i. at 10% deflection is satisfactory.

I claim:

1. A rebound exerciser comprising a diaphragm, a supporting frame surrounding said diaphragm, said diaphragm having spaced openings adjacent the periphery thereof, a lacing threaded spirally through said openings and around said frame, at least one resilient padding member extending over the top of said frame, said member having slots therein fitted over said lacing, a plurality of retaining strips extending across said member, said strips overlapping each other, and means for maintaining said strips taut against said member.

2. A rebound exerciser as defined in claim 1 wherein said padding member extends over the periphery of said diaphragm.

3. A rebound exerciser as defined in claim 1 wherein each of said strips has an opening adjacent one end thereof through which said lacing extends to hold one end of each of said strips, and means for holding the opposite end of each of said strips against said member whereby to maintain said strips taut.

4. A rebound exerciser as defined in claim 3 comprising a plurality of additional elongate resilient padding members extending end to end over said frame, a plurality of elongate resilient pads extending end to end over said padding members and under said strips, said pads overlapping said padding members and extending over said slots.

5. A rebound exerciser as defined in claim 3 wherein said holding means comprises additional openings in said opposite ends of said strip, and a second lacing extending through said additional openings for maintaining said strips against said padding members.

6. A rebound exerciser as defined in claim 1 wherein said diaphragm comprises a plurality of superimposed fabric sheets, each of said sheets comprising woven threads extending at right angles to each other, the threads of one of said sheets extending at an angle to the threads of the other of said sheets.

7. A rebound exerciser as defined in claim 5 comprising annular grommets fitted in said openings of said diaphragm and said strips, said grommets securing said strips to said diaphragm, said lacing extending through said grommets.

8. A rebound exerciser as defined in claim 1 wherein a portion of said padding members containing said slots is folded over the side of said frame.

* * * * *